US005740825A

United States Patent [19]

Brunengo

[11] Patent Number: 5,740,825

[45] Date of Patent: Apr. 21, 1998

[54] ARTICULATED STAIR WALKER

[76] Inventor: P. J. Brunengo, 11940 SE. Idleman Rd., Portland, Oreg. 97266

[21] Appl. No.: 799,501

[22] Filed: Feb. 12, 1997

[51] Int. Cl.[6] ..... A61H 3/00

[52] U.S. Cl. ..... 135/67; 135/70; 482/68

[58] Field of Search ..... 135/65, 66, 67, 135/69, 70, 72, 74, 77, 79; 482/66, 68, 69; 297/5–7

[56] References Cited

U.S. PATENT DOCUMENTS

| | | | |
|---|---|---|---|
| 2,708,473 | 5/1955 | Gable et al. | 135/67 |
| 2,796,916 | 6/1957 | Womble | 135/67 |
| 3,176,700 | 4/1965 | Drury | 135/67 |
| 3,387,618 | 6/1968 | Swann | 135/67 |
| 3,421,529 | 1/1969 | Vestal | 135/67 |
| 3,455,313 | 7/1969 | King . | |
| 4,094,331 | 6/1978 | Rozsa . | |
| 4,248,256 | 2/1981 | Thomas . | |
| 4,434,808 | 3/1984 | Burak | 135/70 X |
| 5,349,977 | 9/1994 | Wood | 135/67 |
| 5,649,558 | 7/1997 | Richard | 135/79 X |

*Primary Examiner*—Lanna Mai

[57] ABSTRACT

An articulated stair walker for traversing staircases including a frame with first and second side sections. Each side section includes a vertical front leg, a vertical rear leg, a horizontal upper tie bar and a horizontal lower tie bar. Each tie bar is pivotally coupled to a front and rear leg of a side section. The side sections are coupled together by an upper and a lower cross bar rigidly affixed between the vertical front legs. Further provided is a lock pin being slidably coupled to each of the side sections and operated by a lever in an L-shaped configuration. One quadrant cam with a plurality of slots is coupled to each of the lower horizontal tie bars. Associated therewith is a lock pin movably coupled to one of the sections and positionable within a slot of the quadrant cam. By this structure, the user may lift the lock pin upwardly to allow the rear legs to be moved downward relative to the front legs. When properly displaced, to accommodate the stair riser height, the operating lever is released to lock the lock pin in the quadrant cam slot.

1 Claim, 4 Drawing Sheets

10
12
14
16
18
20
22
24
26
28
30
32
34
40
42
46
48
50
54
55
4

5
5
18
32
16
28
22
58
54
28
62
18
44
34
56
56
42
30
50
52
24
20
40
26
6
6

Fig. 5
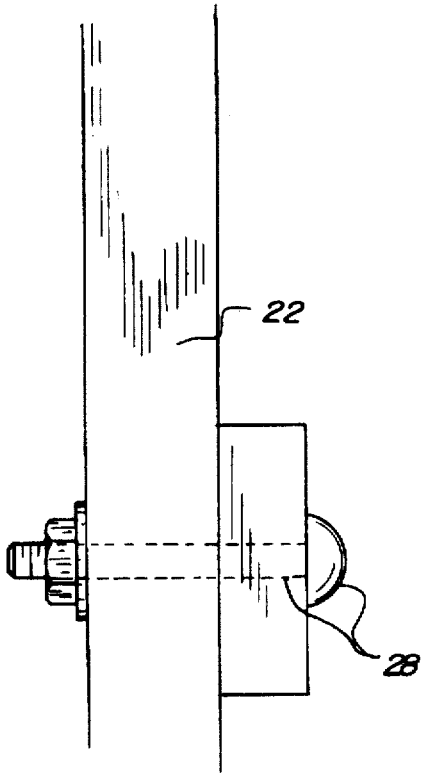
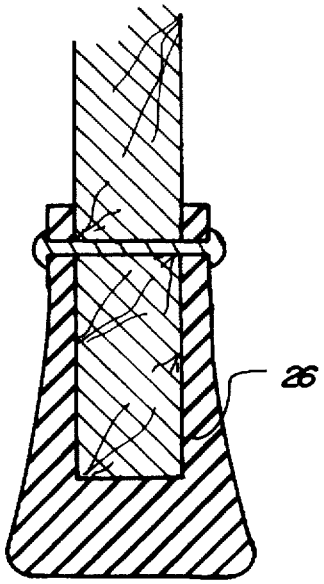
Fig. 6

ARTICULATED STAIR WALKER

BACKGROUND OF THE INVENTION

1. Field of the Invention

The present invention relates to an articulated stair walker for traversing staircases and more particularly pertains to climbing or descending staircases by manipulating the articulated legs of the apparatus.

2. Description of the Prior Art

The use of walker devices is known in the prior art. More specifically, walker devices heretofore devised and utilized for the purpose of providing assistance to individuals with walking related physical disabilities are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,263,506 to Narramore a stairs walker.

U.S. Pat. No. 5,349,977 to Wood discloses an adjustable walker.

U.S. Pat. No. 4,777,973 to Nakajima discloses an alternate walker having extensible/contractible front and rear legs.

U.S. Pat. No. 3,800,815 to Birk discloses an invalid walker.

Lastly, U.S. Pat. No. 3,455,313 to King discloses a walker for ascending and descending ramps and staircases.

In this respect, the articulated walker for traversing staircases according to the present invention substantially departs from the conventional concepts and designs of the prior art, and in doing so provides an apparatus primarily developed for the purpose of climbing or descending staircases by manipulating the articulated legs of the apparatus.

Therefore, it can be appreciated that there exists a continuing need for a new and improved articulated walker for traversing staircases which can be used for climbing or descending staircases by manipulating the articulated legs of the apparatus. In this regard, the present invention substantially fulfills this need.

SUMMARY OF THE INVENTION

In view of the foregoing disadvantages inherent in the known types of walker devices now present in the prior art, the present invention provides an improved articulated stair walker. As such, the general purpose of the present invention, which will be described subsequently in greater detail, is to provide a new and improved articulated stair walker which has all the advantages of the prior art and none of the disadvantages.

To attain this, the present invention includes a frame including first and second side sections and an intermediate section therebetween, each side section including a front leg, a rear leg, an upper tie bar and a lower tie bar, each leg being positioned vertically and including an upper extent and a lower extent, the lower extent of each leg including an elastomeric foot positioned thereupon, each upper tie bar being positioned horizontally and having two free ends pivotally coupled to the upper extent of each leg, each lower tie bar being positioned horizontally and having two free ends pivotally coupled to each leg above its lower extent; an intermediate section including two vertical beams with upper and lower extents, the upper and lower extent of each vertical beam being pivotally coupled to the approximate centerpoint of the upper and lower tie bars; a front section including an upper cross bar and a lower cross bar, the upper cross bar being positioned horizontally being rigidly affixed to the upper extent of the front legs, each lower cross bar being positioned horizontally and being rigidly affixed to the front legs at their lower extent; a lift assembly comprising two lock pin rods, two lock pin lifts, four lock pin springs, lock pins and two quadrant cams, the lock pin rods being positioned vertically and having an upper extent and lower extent, the upper extent of each lock pin rod being slidably coupled to the approximate centerpoint of each upper tie bar, each lock pin rod including an aperture above its lower extent, each lock pin lift including an inboard piece and outboard piece, each outboard piece having a pivoting end and rounded gripping end, the outboard piece being pivotally coupled to a lock pin rod below its upper extent, each inboard piece having a first end pivotally coupled to the tie bar and a second end pivotally coupled to the pivoting end of the outboard piece; two quadrant cams formed in a planar, generally arc shaped configuration with a rounded upper end and a lower end affixed to the lower tie bar, each upper end having a periphery including a plurality of equidistantly spaced slots, two cylindrical shaped lock pins each with two free ends, the cylindrical shaped lock pins including a pair of top pins each with a first end fixedly coupled to a top aperture formed in the lower extent of the corresponding lock pin rod and a second end slidably coupled within a vertical slot formed in the lower extent of the corresponding vertical beam of the intermediate section, the cylindrical shaped lock pins further including a pair of bottom pins each with a first end slidably coupled within a vertical slot formed in the lower extent of the corresponding lock pin rod and a second end fixedly coupled within a bottom aperture formed in the lower extent of the corresponding vertical beam of the intermediate section, the springs coupled between the associated first ends and associated second ends thereby urging the lock pin downward into a slot and further allowing removal of the pins upon the biasing of the corresponding lock pin rod upwardly via the lock pin lift; and two leg springs each having an upper end and a lower end, the upper end of each spring being coupled to the upper extent of the front leg, the lower end of each spring being coupled to the lower extent of the rear leg, whereby in an operative orientation, the user places the front legs of the walker on a first step of a staircase and lifts the gripping ends of the lock pin lifts upwardly, with this action raising the locking pins that are movable and allowing the rear legs to be pivoted downwardly, the user then releasing the lifts, thereby locking each movable lock pin within a slot of the quadrant cam and securing the rear leg in the downward position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved articulated stair walker which has all the advantages of the prior art walker devices and none of the disadvantages.

It is another object of the present invention to provide a new and improved articulated stair walker which may be easily and efficiently manufactured and marketed.

It is a further object of the present invention to provide a new and improved articulated stair walker which is of a durable and reliable construction.

An even further object of the present invention is to provide a new and improved articulated stair walker which is susceptible of a low cost of manufacture with regard to both materials and labor, and which accordingly is then susceptible of low prices of sale to the consuming public, thereby making such articulated stair walker economically available to the buying public.

Still yet another object of the present invention is to provide a new and improved articulated stair walker which provides in the apparatuses and methods of the prior art some of the advantages thereof, while simultaneously overcoming some of the disadvantages normally associated therewith.

Still another object of the present invention is to climbing or descend staircases by manipulating the articulated legs of the apparatus.

Lastly, it is an object of the present invention to provide a new and improved articulated stair walker for traversing staircases including a frame with first and second side sections. Each side section includes a vertical front leg, a vertical rear leg, a horizontal upper tie bar and a horizontal lower tie bar. Each tie bar is pivotally coupled to a front and rear leg of a side section. The side sections are coupled together by an upper and a lower cross bar rigidly affixed between the vertical front legs. Further provided is a lock pin being slidably coupled to each of the side sections and operated by a lever in an L-shaped configuration. One quadrant cam with a plurality of slots is coupled to each of the lower horizontal bars. Associated therewith is a lock pin movably coupled to one of the sections and positionable within a slot of the quadrant cam. By this structure, the user may lift the lock pin upwardly to allow the rear legs to be moved downward relative to the front legs. When properly displaced, to accommodate the stair riser height, the operating lever is released to lock the lock pin in the quadrant cam slot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an enlarged isolated perspective view of an upper tie bar of the apparatus taken along section line 5—5 of FIG. 2.

FIG. 6 is an enlarged cross sectional view of an elastomeric foot of the apparatus taken along section line 6—6 of FIG. 2.

The same reference numerals refer to the same parts through the various Figures.

Similar reference characters refer to similar parts throughout the several views of the drawings.

DESCRIPTION OF THE PREFERRED EMBODIMENT

Figure 1:
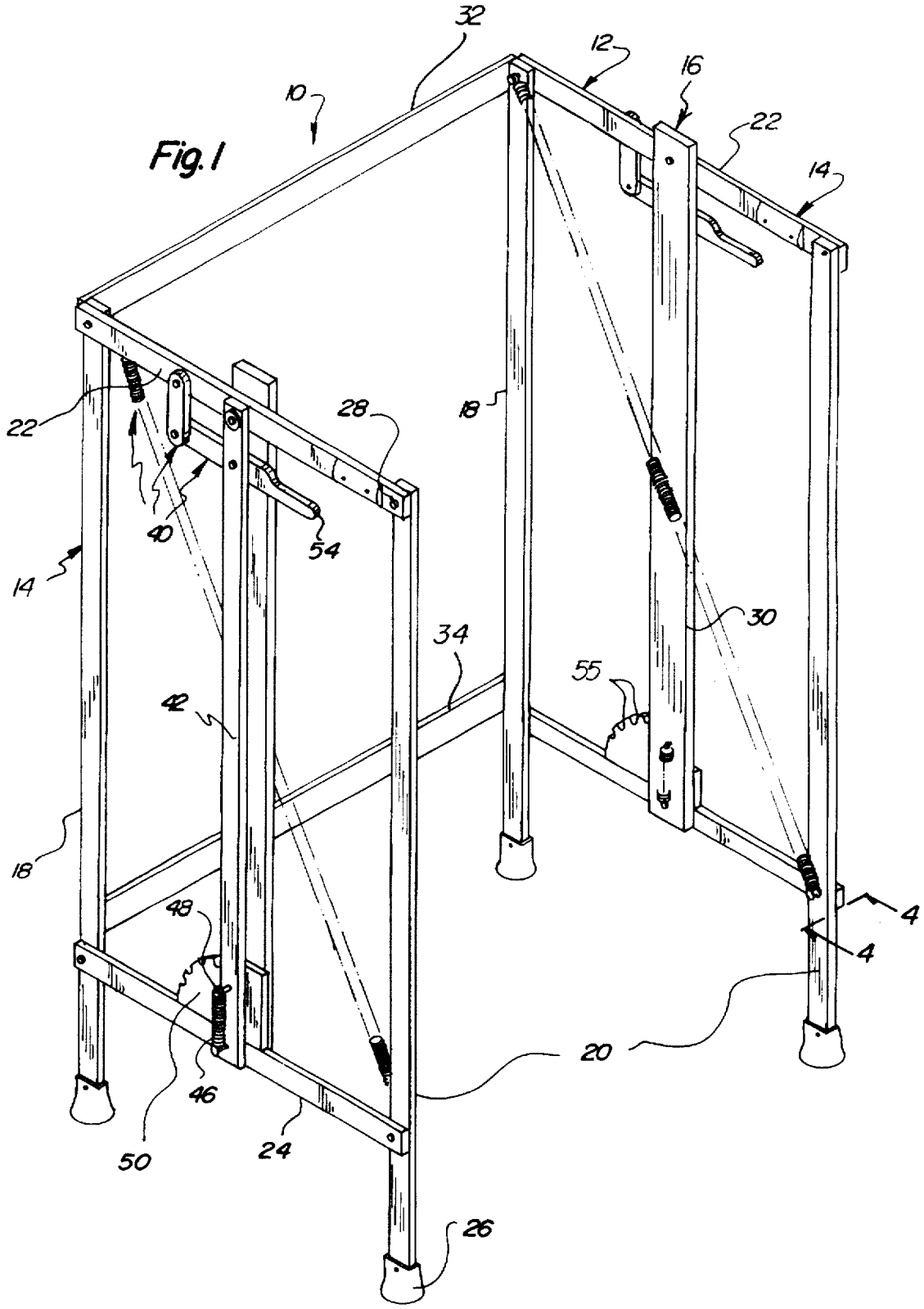
FIG. 1 is a perspective view of the preferred embodiment of the articulated walker for traversing staircases constructed in accordance with the principles of the present invention.

With reference now to the drawings, and in particular to FIG. 1 thereof, the preferred embodiment of the new and improved articulated walker for traversing staircases embodying the principles and concepts of the present invention and generally designated by the reference numeral 10 will be described.

The present invention, the articulated walker for traversing staircases 10 is comprised of a plurality of components. Such components in their broadest context include a frame 12, a first side section 14, a second side section 16, and a lift apparatus 40. Such components are individually configured and correlated with respect to each other so as to attain the desired objective.

The articulated walker for traversing staircases 10 is intended to assist the user in climbing or descending stairs as well as providing support during level floor use. Its design results in unusual stability because the legs are always vertical regardless of the amount of displacement to accommodate stair riser height. The lock pins 48 are always positively seated in the quadrant cams except when being adjusted through the operation of the lock pin lifts 40. The pair of leg springs 56, 58 return the apparatus to its flat or level position automatically when the locking pins are raised by the action of the lock pin lifts. Note FIG. 1.

Figure 2:
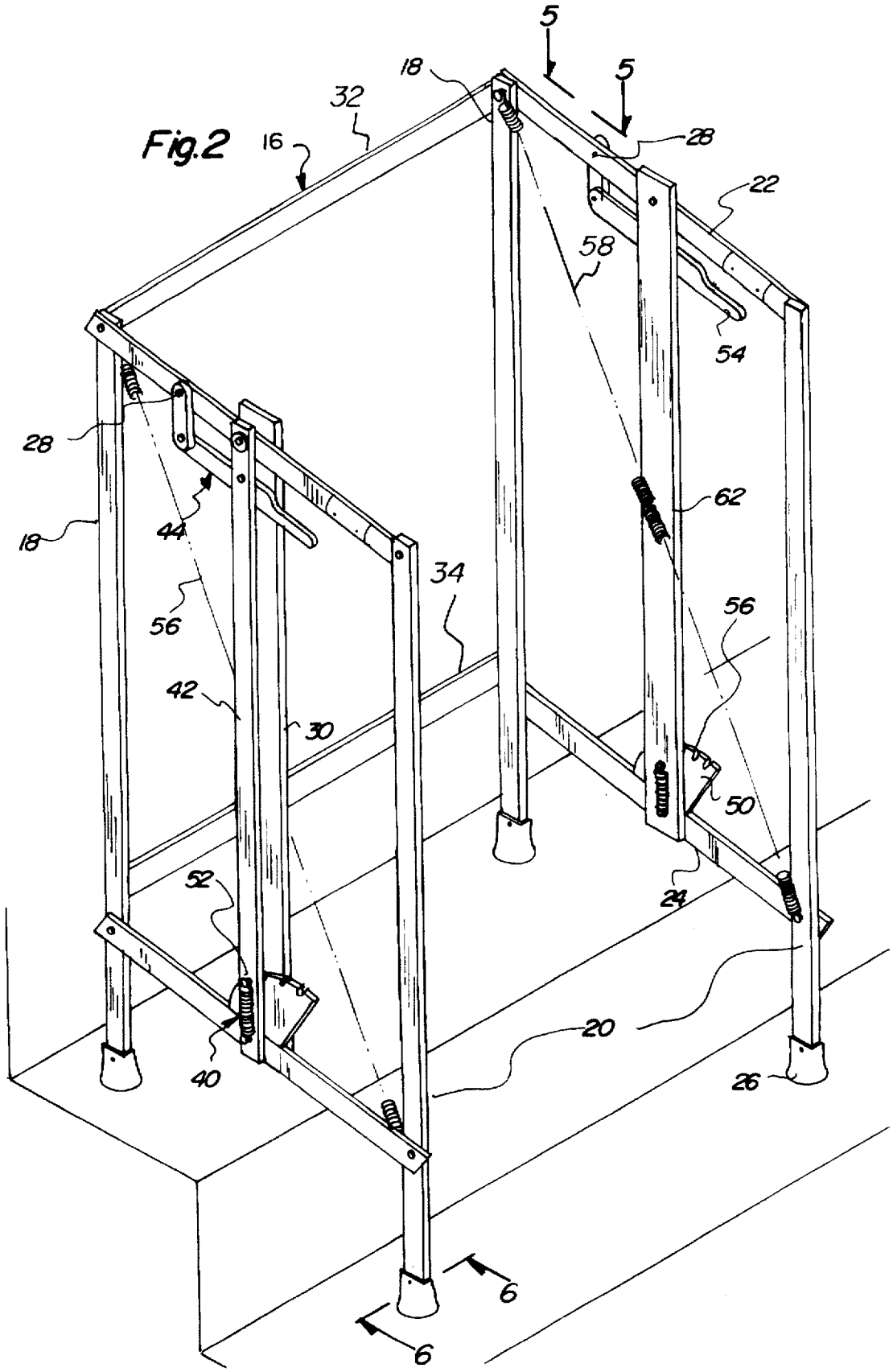
FIG. 2 is perspective view of the apparatus with the front legs positioned upon a staircase.

More specifically, the frame 12 is fabricated of wood, plastic or metal and includes first and second side sections 14 and an intermediate section 16 therebetween. Each side section includes a front leg 18, a rear leg 20, an upper tie bar 22 and a lower tie bar 24. Each leg is positioned vertically and includes an upper extent and a lower extent. The lower extent of each leg includes an elastomeric foot 26 positioned upon it. The feet prevent slippage of the apparatus during use. Each upper tie bar is positioned horizontally and has two free ends. The free ends are pivotally coupled to the upper extent of each leg by a pivot bolt 28. Each lower tie bar is positioned horizontally and has two free ends. The free ends are pivotally coupled to each leg above its lower extent by a pivot bolt. Note FIGS. 1, 2 and 6.

The intermediate section 16 includes two vertical beams 30 with upper and lower extents. The upper and lower extent of each vertical beam of the intermediate section are pivotally coupled to the approximate centerpoint of the upper and lower tie bars of each side section. When utilizing the apparatus the user stands approximately between the rear legs. Note FIG. 2.

Further included is a front section with an upper cross bar 32 and a lower cross bar 34. The upper cross bar is positioned horizontally and is rigidly affixed to the upper extent of each front leg. Each lower cross bar is positioned horizontally and is rigidly affixed to the front legs at their lower extent.

A lift assembly 40 comprises two lock pin rods 42, two lock pin lifts 44, four lock pin springs 46 and lock pins 48 and two quadrant cams 50. The lock pin rods are positioned vertically and have an upper extent and lower extent. The upper extent of each lock pin rod is slidably coupled within a vertically oriented oval slot at the approximate centerpoint of each upper tie bar. Each lock pin lift includes an inboard piece and outboard piece. Note FIG. 2. Each outboard piece has a pivoting end and rounded gripping end 54. The gripping end has a smooth surface to enhance comfort to the user. The approximate centerpoint of the outboard piece is pivotally coupled to a lock pin rod below its upper extent. Each inboard piece has a first end pivotally coupled to the tie bar adjacent to the shaft of the frame. Each inboard piece has a second end pivotally coupled to the pivoting end of the outboard piece. Note FIG. 2. Situated adjacent to each rounded gripping end of the outboard piece is a cylindrical handle coupled to the corresponding upper tie bar. As shown in the Figures, such handle comprises a pair of semi-cylindrical pieces riveted together.

Figure 3:
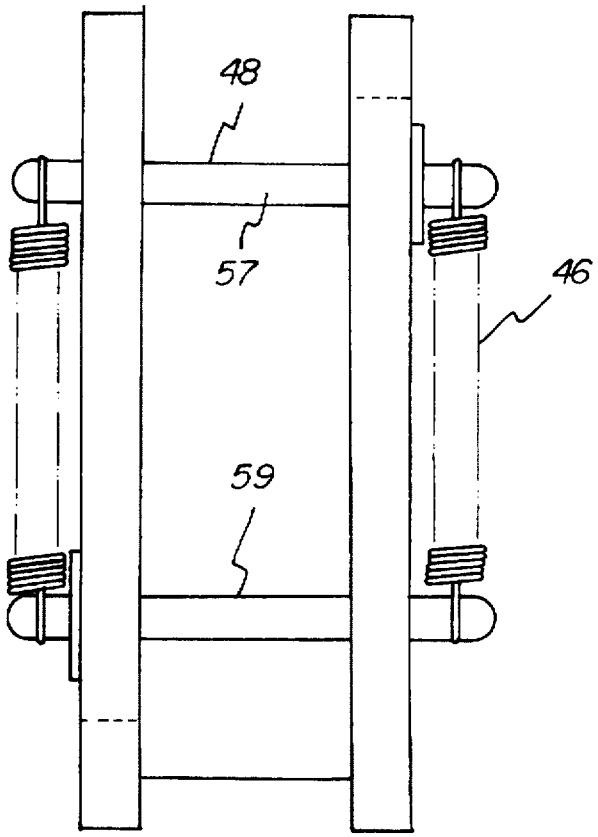
FIG. 3 is a cross-sectional view of the lock pins of the present invention and the vertical slots associated therewith.

Two quadrant cams 50 are formed in a planar, generally arc shaped configuration with a rounded upper end and a lower end which is affixed to the lower tie bar. Each upper end has a periphery which includes a plurality of equidistantly spaced slots 55. The cylindrical shaped lock pins include a pair of top pins 57 each with a first end fixedly coupled to a top aperture formed in the lower extent of the corresponding lock pin rod. Note FIG. 3. A second end of each top pin is slidably coupled within a vertically oriented oval slot formed in the lower extent of the corresponding vertical beam of the intermediate section. With reference still to FIG. 3, it can be seen that the cylindrical shaped lock pins further include a pair of bottom pins 59 each with a first end slidably coupled within a vertically oriented slot formed in the lower extent of the corresponding lock pin rod. A second end of each bottom pin is fixedly coupled within a bottom aperture formed in the lower extent of the corresponding vertical beam of the intermediate section. The springs 46 are coupled between the associated first ends and further additional springs are coupled between associated second ends thereby urging the lock pin downward into a slot and further allowing removal of the pins upon the biasing of the corresponding lock pin rod upwardly via the associated lock pin lift. As shown in FIG. 3, the bottom and top rods are kept in a perpendicular relationship with the associated vertical slots by means of washers fixedly attached to the ends of the top and bottom pins that move with respect to a corresponding lock pin rod and vertical beam.

Figure 4:
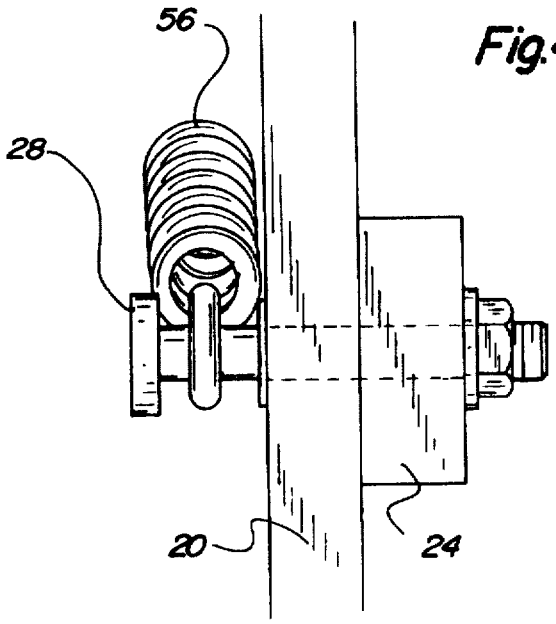
FIG. 4 is an enlarged isolated perspective view of a rear leg of the apparatus taken along section line 4—4 of FIG. 1.

A first and second leg spring 56, 58 are each formed as a single piece with an upper end and a lower end. The upper end of the first and second leg spring are each coupled to the upper extent of the corresponding front leg. The lower end of the first and second leg spring are coupled to the associated rear leg adjacent to the lower tie bar. Note FIGS. 1 and 4. It should be noted that only one spring is necessary on each side section since the rear legs are prevented from raising above the level of the front legs by means of an unillustrated extension at the top rear of the cams which extends above the elevation of the raised locking pins.

To utilize the apparatus to walk upstairs the user first positions himself approximately between the rear legs, facing the cross bars 32, 34. The user places the front legs of the walker on a first step of a staircase and lifts the gripping end of the lock pin lift. This action disengages the locking pins from the cam slots allowing the rear legs to be pivoted downwardly until they contact the floor. With the apparatus in this position the user may proceed to the top of the stairs one step at a time. Once the top of the staircase has been reached the lock pin lifts 44 are released and the apparatus returned to its normal level position. Note FIGS. 1 and 2.

To utilize the apparatus to descend a staircase, the user first positions herself between the rear legs 20 with his or her back facing the staircase. The user then descends the staircase backwards utilizing same method as noted above.

In an alternate embodiment, the lock pin lift may be lifted by pinion gears driven by battery powered motors. The motors are operatively coupled to the lock pin lifts. The alternative embodiment requires significantly less effort to accomplish the vertical leg adjustments necessary to traverse a staircase. This embodiment is particularly useful to severely physically challenged individuals.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved articulated stair walker for traversing staircases comprising, in combination:

a frame including first and second side sections and an intermediate section therebetween, each side section including a front leg, a rear leg, an upper tie bar and a lower tie bar, each leg being positioned vertically and including an upper extent and a lower extent, the lower extent of each leg including an elastomeric foot positioned thereupon, each upper tie bar being positioned horizontally and having two free ends pivotally coupled to the upper extent of each leg, each lower tie bar being positioned horizontally and having two free ends pivotally coupled to each leg above its lower extent;

an intermediate section including two vertical beams with upper and lower extents, the upper and lower extent of each vertical beam being pivotally coupled to the approximate centerpoint of the upper and lower tie bars;

a front section including an upper cross bar and a lower cross bar, the upper cross bar being positioned horizontally being rigidly affixed to the upper extent of the front legs, each lower cross bar being positioned horizontally and being rigidly affixed to the front legs at their lower extent;

a lift assembly comprising two lock pin rods, two lock pin lifts, four lock pin springs, lock pins and two quadrant cams, the lock pin rods being positioned vertically and having an upper extent and lower extent, the upper extent of each lock pin rod being slidably coupled to the approximate centerpoint of each upper tie bar, each lock pin rod including an aperture above its lower extent, each lock pin lift including an inboard piece and outboard piece, each outboard piece having a pivoting end and rounded gripping end, the outboard piece being pivotally coupled to a lock pin rod below its upper extent, each inboard piece having a first end pivotally coupled to the tie bar and a second end pivotally coupled to the pivoting end of the outboard piece;

two quadrant cams formed in a planar, generally arc shaped configuration with a rounded upper end and a lower end affixed to the lower tie bar, each upper end having a periphery including a plurality of equidistantly spaced slots, two cylindrical shaped lock pins each with two free ends, the cylindrical shaped lock pins including a pair of top pins each with a first end fixedly coupled to a top aperture formed in the lower extent of the corresponding lock pin rod and a second end slidably coupled within a vertical slot formed in the lower extent of the corresponding vertical beam of the intermediate section, the cylindrical shaped lock pins further including a pair of bottom pins each with a first end slidably coupled within a vertical slot formed in the lower extent of the corresponding lock pin rod and a second end fixedly coupled within a bottom aperture formed in the lower extent of the corresponding vertical beam of the intermediate section, the springs coupled between the associated first ends and associated second ends thereby urging the lock pin downward into a slot and further allowing removal of the pins upon the biasing of the corresponding lock pin rod upwardly via the lock pin lift; and two leg springs each having an upper end and a lower end, the upper end of each spring being coupled to the upper extent of the front leg, the lower end of each spring being coupled to the lower extent of the rear leg, whereby in an operative orientation, the user places the front legs of the walker on a first step of a staircase and lifts the gripping ends of the lock pin lifts upwardly, with this action raising the locking pins that are movable and allowing the rear legs to be pivoted downwardly, the user then releasing the lifts, thereby locking each movable lock pin within a slot of the quadrant cam and securing the rear leg in the downward position.

* * * * *